US009415972B2

(12) United States Patent
Tanaka

(10) Patent No.: US 9,415,972 B2
(45) Date of Patent: Aug. 16, 2016

(54) ELEVATOR OPERATION CONTROL METHOD AND OPERATION CONTROL DEVICE

(71) Applicant: TOSHIBA ELEVATOR KABUSHIKI KAISHA, Tokyo (JP)

(72) Inventor: Kazuhiro Tanaka, Tokyo (JP)

(73) Assignee: TOSHIBA ELEVATOR KABUSHIKI KAISHA, Tokyo (JP)

( * ) Notice: Subject to any disclaimer, the term of this patent is extended or adjusted under 35 U.S.C. 154(b) by 466 days.

(21) Appl. No.: 14/075,720

(22) Filed: Nov. 8, 2013

(65) Prior Publication Data

US 2014/0131141 A1 May 15, 2014

(30) Foreign Application Priority Data

Nov. 15, 2012 (JP) ..... 2012-250879

(51) Int. Cl.
*B66B 1/34* (2006.01)
*B66B 1/28* (2006.01)
*B66B 7/06* (2006.01)

(52) U.S. Cl.
CPC .... *B66B 1/28* (2013.01); *B66B 7/06* (2013.01)

(58) Field of Classification Search
CPC ..... G01C 9/00; G06F 17/50; B66B 1/28; B66B 5/022; B66B 7/06
USPC ..... 187/247, 278, 292, 293, 296, 297, 313, 187/380–388, 391–393; 702/150
See application file for complete search history.

(56) References Cited

U.S. PATENT DOCUMENTS 3,792,759 A * 2/1974 Kirsch ..... B66B 5/022 187/278
4,809,817 A * 3/1989 Kawai ..... B66B 5/022 187/278
6,701,281 B2 * 3/2004 Satoh ..... G06F 17/5004 702/152
7,681,696 B2 * 3/2010 Yamagishi ..... B66B 5/022 187/313
7,789,204 B2 * 9/2010 Amano ..... B66B 5/0025 187/247
7,905,329 B2 3/2011 Urata
7,909,144 B2 * 3/2011 Fukui ..... B66B 5/02 187/292
7,926,620 B2 * 4/2011 Amano ..... B66B 5/027 187/278
8,297,412 B2 * 10/2012 Roberts ..... B66B 1/2416 187/292

(Continued)

FOREIGN PATENT DOCUMENTS

JP 2007-153520 A 6/2007
JP 2008-044701 A 2/2008

(Continued)

*Primary Examiner* — Anthony Salata
(74) *Attorney, Agent, or Firm* — Foley & Lardner LLP

(57) ABSTRACT

The elevator operation control method according to the embodiment estimate the amount of shake of a long object which moves accompanying lifting and lowering of a passenger cage by way of simulation based on the amount of shake of a building in which an elevator is installed and current position information of the passenger cage of the elevator. The elevator operation control method change every second a physical model of the simulation according to the position of the running passenger cage, and simulate in real time the amount of shake of the long object from a current amount of shake of the building and position information of the running passenger cage. The elevator operation control method compare the amount of shake of the long object calculated by the simulation and a threshold, and perform a control operation according to the result.

6 Claims, 3 Drawing Sheets

(56) References Cited

U.S. PATENT DOCUMENTS

| | | | | |
|---|---|---|---|---|
| 8,579,089 | B2 * | 11/2013 | Hakala | B66B 1/24 187/278 |
| 9,045,313 | B2 * | 6/2015 | Benosman | B66B 7/06 |
| 2006/0266591 | A1 | 11/2006 | Zhu et al. | |
| 2010/0213013 | A1 | 8/2010 | Urata | |
| 2013/0275081 | A1 | 10/2013 | Benosman et al. | |
| 2014/0167969 | A1 * | 6/2014 | Wedig | G08B 7/066 340/584 |
| 2016/0011325 | A1 * | 1/2016 | Taya | G01V 1/303 702/15 |

FOREIGN PATENT DOCUMENTS

| | | | |
|---|---|---|---|
| JP | 4399438 | B2 | 1/2010 |
| JP | 2010-052924 | A | 3/2010 |
| JP | 4618101 | B2 | 1/2011 |
| WO | WO 2013/153881 | A1 | 10/2013 |

* cited by examiner

ELEVATOR OPERATION CONTROL METHOD AND OPERATION CONTROL DEVICE

CROSS-REFERENCE TO RELATED APPLICATIONS

This application is based upon and claims the benefit of priority from the prior the Japanese Patent Application No. 2012-250879, filed on Nov. 15, 2012, and the entire contents of which are incorporated herein by reference.

FIELD

An embodiment of the present invention relates to an elevator operation control method and operation control device which estimate an amount of shake of a long object such as a main rope based on a shake of a building by way of simulation, and control and operate an elevator according to the estimated amount of shake.

BACKGROUND

When a building is verticalized, a natural frequency of the building decreases, and therefore, when an earthquake occurs or a strong wind blows, a resonance phenomenon is likely to occur. When the natural frequency of the building and a natural frequency of a rope (such as a main rope, a compensating rope or a governor rope) of an elevator provided in a hoistway match, the rope is shaken greatly due to resonance. Hence, there is a concern that the rope contacts a device in the hoistway or a hoistway wall, and causes failure such as a catch of a rope.

To prevent this failure, a recent elevator first detects a shake of the building by means of a sensor installed in, for example, a machine room when the building is shaken. When the detected intensity and a continuation time exceed a certain threshold, a control operation is performed. That is, a passenger cage is moved to an evacuation floor (non-resonant floor), and operation service is stopped to prevent a catch of a rope. However, when a control operation is performed based only on the shake of the building and the continuation time of the shake, an elevator is stopped even though a rope is not actually shaken greatly, there is a concern that a stop frequency unnecessarily increases. Accompanying verticalization of buildings, a recent building adopts a structure which is easily shaken, and therefore, when the building is shaken by a wind, the control operation is launched every time and disturbs operation service.

Hence, Japan Patent No. 4399438 proposes an elevator device which, when a building is shaken by an earthquake or a strong wind, computes the amount of shake of a long object (such as a main rope, a compensating rope or a governor rope) in a hoistway according to a building shake signal, and controls and operates the elevator according to the result. With this elevator device, primary natural periods are different per shake in lateral and longitudinal directions of the building, and then a plurality of long object shake vibration models to which different natural periods (Ta, Tb, Tc: fixed values) are set are determined for the respective primary natural periods of the building and the amount of shake of the long object based on the building shake signal is computed per shake vibration model.

Further, upon an actual operation, a control operation of an elevator upon an earthquake and building shake control which is conventionally adopted are used in combination, and, even when a weak P wave first break caused by a long-period ground motion is missed, long object shake control is performed by S wave early sensing. That is, a long object shake grows over about 30 to 60 seconds after the S wave arrives, and a passenger cage is temporarily stopped at the nearest floor by S wave early control and the amount of shake of a long object is computed. An operation returns to a normal operation when a shake of the building is a little after a certain period of time and the long object is not shaken, and a control operation matching the amount of shake is performed when the long object is shaken.

Although this control is preferable to handle the earthquake, when a building is shaken by a strong wind, a passenger cage stops at the nearest floor due to a comparatively weak shake, and therefore it is difficult to decrease a stop frequency.

Further, upon computation of a shake of along object, natural periods of long object shake vibration models are fixed values Ta, Tb and Tc close to the primary natural period of the building, and assume a state where the shake of the long object is the greatest. The shake of the long object changes every second depending on a position of a passenger cage, and therefore it is not possible to calculate an accurate shake of the long object according to the vibration model which assumes a maximum shake at all times as described above.

Further, as another example, Japan Patent No. 4618101 also proposes an elevator control operation device which, when detecting a shake of a building due to an earthquake or a strong wind, predicts that various ropes of an elevator are caught by projections in a hoistway and transitions an operation to a control operation.

When a shake of a certain magnitude or more of a building occurs, this elevator control operation device temporarily stops the elevator and calculates the degree of a shake of each rope using, for example, building shake information or elevator cage position information. Further, the calculated degree of shake of the rope and a determination reference are compared to determine a likelihood of a catch of each rope and prevent the rope from being caught due to the operation of the elevator.

According to the above two examples, when a shake of a building is a certain magnitude or more, the operation of the elevator is first stopped and a shake of the rope (long object) is subsequently estimated, and therefore it is not possible to reduce a stop frequency of the elevator.

DETAILED DESCRIPTION

The elevator operation control method and operation control device according to the embodiment estimate the amount of shake of a long object which moves accompanying lifting and lowering of a passenger cage by way of simulation based on the amount of shake of a building in which an elevator is installed and current position information of the passenger cage of the elevator. The elevator operation control method and operation control device control and operate the elevator according to the estimated amount of shake of the long object. The elevator operation control method and operation control device change every second a physical model of the simulation according to a position of the running passenger cage, and simulates in real time the amount of shake of the long object from a current amount of shake of the building and position information of the running passenger cage. The elevator operation control method and operation control device perform a control operation matching this threshold when the amount of shake of the long object calculated by this simulation exceeds a threshold determined in advance.

The embodiment of the present invention will be described in detail below using the attached drawings as an example.

Figure 1:
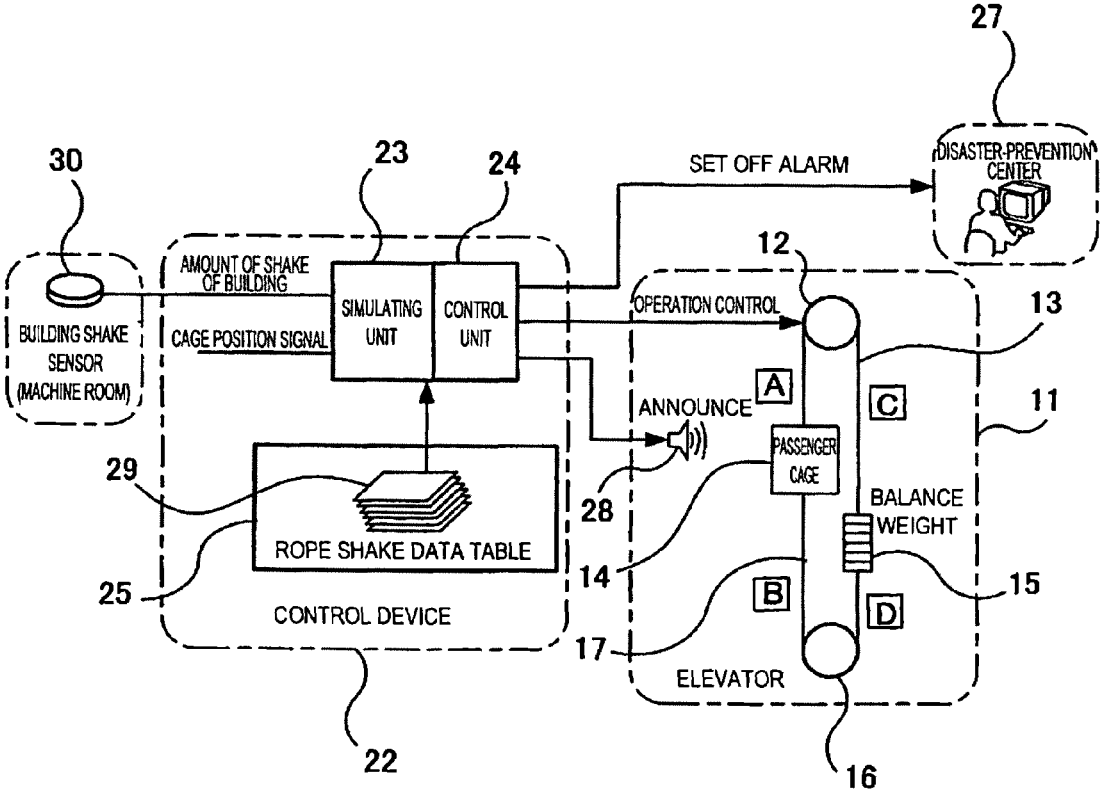
FIG. 1 is a configuration diagram of an elevator operation control device according to an embodiment of the present invention.

In FIG. 1, an elevator 11 is installed in a hoistway in a building which is not illustrated. In a machine room at a top part of this building, a hoist 12 which is a driving source of the elevator 11 is installed. A main rope 13 is wound around this hoist 12, and a passenger cage 14 is attached to one end of the main rope and a counter weight 15 is attached to the other example. Further, a compensating sheave 16 is disposed at a bottom part of the hoistway, a compensating rope 17 is wound around this compensating sheave 16 and, at both end portions of the compensating rope, lower portions of the passenger cage 14 and the counter weight 15 are attached.

In addition to these, a governor rope which is not illustrated and is vertically stretched in the hoistway and a tail cord (transmission cable) which connects between the passenger cage 14 and a control device 22 described below are provided, and move accompanying lifting and lowering of the passenger cage 14. Hereinafter, the main rope 13, compensating rope 17, and the governor rope and the tail cord which are not illustrated are collectively referred to as a long object.

The control device 22 controls an operation of the elevator 11, and is generally provided in the machine room at the top part of the building. This control device 22 is configured with a computer on which a CPU, a ROM and a RAM are mounted. Functionally, this control device has the simulating unit 23 and the control unit 24 which are realized by the CPU, and a memory unit 25 which is configured by, for example, the ROM and the RAM.

The simulating unit 23 has a function of, when a building is shaken by an earthquake or a strong wind, estimating a shake of a long object accompanying this shake. The control unit 24 has, for example, a function of executing a series of processing related to operation control of the elevator 11 such as driving control of the hoist 12, and controlling an operation of the passenger cage 14 based on a shake estimation result of the long object obtained by the simulating unit 23. In addition to this, the control unit 24 performs alarm processing to a disaster-prevention center 27 or an alarming device 28 in the elevator 11 based on the simulation result of the simulating unit 23.

The memory unit 25 stores various items of data and programs which are not illustrated and are required to control an operation of the elevator. Further, a data table 29 which is described below and is used to estimate a shake of a long object is configured.

A shake of the building is measured by a shake sensor 30 which is provided in, for example, the machine room at the top part of the building. For this shake sensor 30, for example, an acceleration sensor is used.

The above simulating unit 23 estimates the amount of shake of the long object which moves accompanying lifting and lowering of the passenger cage 14 based on the amount of shake of the building in which the elevator 11 is installed and current position information of the passenger cage 14 of the elevator 11. That is, the simulating unit 23 changes every second a physical model of simulation according to a position of the running passenger cage 14 and the amount of shake of a building, and simulates in real time the amount of shake of the long object from a current amount of shake of the building and position information of the running passenger cage 14.

Meanwhile, various methods of estimating the amount of shake of a long object caused by a shake of a building have been proposed. The applicant of this application proposed a rope shake simulator (an analysis program which operates on a PC), and estimates the amount of shake by performing analysis using this simulator. When receiving an input of given limited input conditions, that is, a predetermined building input wave (time-series shake data of a building or Sin wave data) and a passenger cage position (fixed value), this simulator obtains time-series data of a shake of a rope as an output. This simulator is very useful for the above predetermined building input wave and a fixed cage position, and, in experiments of many buildings, matches between analysis values and actual amounts of shake of a rope are checked.

Although the simulating unit 23 according to the present embodiment is appropriated from the above simulator, the above simulator performs simulation using a position of the passenger cage as a fixed value. However, upon an operation of the elevator, the position of the passenger cage changes every second and a natural period (frequency) of a long object also changes accompanying a change of this position of the passenger cage, and therefore a simulator which assumes a fixed position of the passenger cage is not applied as is.

A relationship between a shake of a long object and a position of a passenger cage will be described below. The long object collectively refers to the main rope 13, and the compensating rope 17, the governor rope and the tail cord as described above, the main rope 13 and the compensating rope 17 which are illustrated herein will be described.

The main rope 13 is partitioned into a portion (a portion A in FIG. 1) attached to the passenger cage 14 side and a portion (a portion C in FIG. 1) attached to the counter weight 15 side. The compensating rope 17 is partitioned into a portion (a portion B in FIG. 1) attached to the passenger cage 14 side and a portion (a portion D in FIG. 1) attached to the counter weight 15 side.

The lengths of the portions A, C, B and D of these long objects 13 and 17 change depending on the position of the passenger cage 14. When, for example, the main rope 13 is focused upon and the passenger cage 14 is at the bottom floor, while the portion A of the main rope 13 (simply referred to as a rope A below) of the passenger cage 14 side is the longest, the portion C of the main rope 13 (simply referred to as a rope C below) of the counter weight 15 side is the shortest. This relationship reverses in case of the compensating rope 17, and, when the passenger cage 14 is at the bottom floor, while the portion B of the compensating rope 17 (simply referred to as a rope B below) of the passenger cage 14 side is the shortest, the portion D of the compensating rope 17 (simply referred to as a rope D below) of the counter weight 15 side is the longest.

Meanwhile, a relationship between a position of the passenger cage 14 and the amount of shake of a long object when the building is shaken at a certain magnitude will be described.

In case of the main rope 13, the rope A of the passenger cage 14 side is shaken the most when the passenger cage 14 is near the position of the bottom floor, and is shaken little at a position in a range from a middle floor to the vicinity of the top floor. Meanwhile, the rope C of the counterweight 15 side is shaken the most when the passenger cage 14 is near the top floor, and is shaken little at a position in a range from the middle floor to the vicinity of the bottom floor.

In case of the compensating rope 17, the rope B of the passenger cage 14 side is shaken the most when the passenger cage 14 is on a floor which is a little higher than the middle floor, and is shaken little at a position in a range from the middle floor to the bottom side. Meanwhile, the rope D of the counterweight 15 side is shaken the most when the passenger cage 14 is on a floor which is a littler lower than the middle floor, and is shaken little from the middle floor to the top side.

Thus, when the lengths of the ropes A, C, B and D which are long objects change, the natural frequencies of these ropes also change, and the amounts of shake of the long objects caused by a shake of the building also change. The above lengths of the ropes A, C, B and D are determined according to the position of the passenger cage 14. The position of the passenger cage 14 is calculated based on the number of times of rotation and the rotation direction of the hoist 12, and the position of the passenger cage 14 is inputted to the control device 22 as a cage position signal at all times.

According to the present embodiment, the simulating unit 23 receives an input of the amount of shake of the building from the shake sensor 30, and receives an input of cage position information of the passenger cage 24 which changes every second, from the hoist 12 side described above. Further, using these input values, the current amount of shake of the long object is calculated in real time. A long-period shake of the building is known to occur as a Sin wave which includes the primary natural frequency f [Hz] and the amplitude A [mm] of the building, and a peak of a shake of the building which shakes the long object comes once in ½ f[s]. Consequently, by continuing estimate calculation of the amount of shake of the long object once in ½ f[s], it is possible to learn the amount of shake of the long object in real time.

The control unit 24 causes an adequate elevator control operation matching the amount of shake of the long object when a shake calculated value of the long object calculated by the simulating unit 23 exceeds a certain threshold. For example, a plurality of levels of thresholds is set, and an alarm is set off to the disaster-prevention center 27 or the alarming device 28 of the elevator 11 according to the amount of shake of the long object or the elevator is operated at a speed which causes a little influence of a shake of the long object or is controlled to stop.

An example of this control operation will be described. The amount of shake of the long object in case that the passenger cage 14 at the current position arrives at a destination floor upon the current amount of shake of the building is predicted using position information of the destination floor. When the amount of shake which is a predicted value is expected to exceed the threshold, a destination floor is changed to a floor at which, for example, the predicted value of the amount of shake of the long object is expected not to exceed the threshold without going to this destination floor.

Thus, when a building is shaken, the position of the passenger cage which changes every second is inputted while the elevator is operated and the amount of shake of the long object is calculated from the amount of shake of the building without first stopping the operation of the elevator as in the conventional technique, so that it is possible to accurately estimate in real time the amount of shake of the long object corresponding to a shake at a current point of time. Further, a control operation is performed according to this result, so that it is possible to dramatically reduce a stop frequency of the elevator compared to the conventional technique and improve operation service of the elevator.

Next, a method of creating the data tables 29 in advance and calculating the amount of shake of a long object caused by a shake of a building using data of these data tables 29 will be described as the simulation method of the simulating unit 23.

In this case, for all passenger cage positions corresponding to a plurality of height positions (for example, floors) set in advance in the building in which the elevator 11 is installed, the simulating unit 23 calculates in advance a time-series change of the amount of shake of the long object corresponding to the amount of shake of the building by means of the above simulator. Further, the data table 29 obtained by converting this result into a table is created and is stored in the memory unit 25. A physical model of simulation of the simulating unit 23 selects the corresponding data table 29 from the current amount of shake of the building and the passenger cage position, and estimates in real time the amount of shake of the long object using information of this data table 29.

Meanwhile, fluctuation elements upon creation of the data tables 29 are as follows.

- Shake of Building . . . N patterns of data in predetermined ranges X0 to XNgal obtained by setting an output of the building shake sensor (acceleration sensor) 30 by a predetermined value Xgal.
- Elapsed time . . . Y/T patterns of data in predetermined time ranges 0 to Y seconds is used by a predetermined time (about half (½ f)=T[s] of a building period f[Hz]).
- Machine . . . When paths are different between machines, the number of machines of different paths is used as machine data.
- Type of long object . . . Each of the ropes A, C, B and D is type data of a long object. When a governor rope and a tail cord are included as long objects, the same data is used for these rope and cord. However, only the main rope and the compensating rope (ropes A, C, B and D) will be described below.
- Cage position . . . A floor position of a building is used as described above in the present embodiment, and each floor is cage position data.

Figure 2:
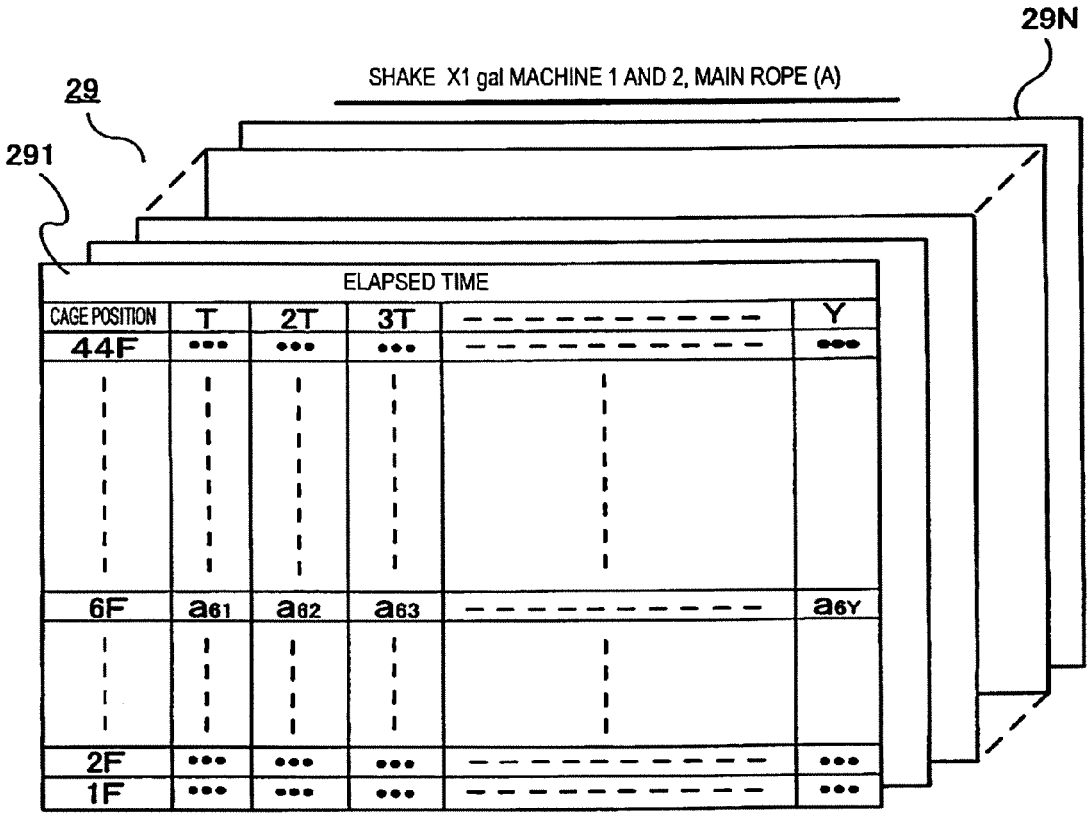
FIG. 2 is a view schematically illustrating a data table used in the embodiment of the present invention.

FIG. 2 illustrates a configuration example of the data table 29 configured using these fluctuation elements. A table 291 in FIG. 2 represents a time-series (by T [s]) change of the amount of shake of the rope A of the machines 1 and 2 of the same path per passenger cage position 1 F to 44 F (there are 44 floors) upon the building shake X1gal. That is, all passenger cage positions 1 F to 44 F set in advance are indicated on the vertical axis and the elapsed times 0 to Y seconds by T seconds are indicated on the horizontal axis, and, at a crossing portion of these axes, the amount of shake of the rope (a numerical value is omitted) calculated for the rope A in advance by the above simulator is set.

N patterns (291 to 29N) of the data tables 29 of this rope A are created in the predetermined ranges X0 to XNgal by the predetermined value Xgal per shake of the building. Further, data tables equivalent to these N patterns of the data tables 29 are created per above machine and per type of the long object.

Next, an example of a method of estimating in real time the amount of shake of a long object using these data tables 29 will be described. A basic theory of estimating in real time the amount of shake of a long object (also referred to as the amount of shake of a rope below) is based on the following equation.

$$D_R = D_R \pm \Delta D_R \quad (1)$$

$$\Delta D_R = F(N, Lt, R, D_{R0}, D_T) \quad (2)$$

In above equations (1) and (2), $D_{R0}$: Default Amount of Shake of Rope (mm)

$D_T$: Amount of Shake of Building (mm)

$D_R$: Amount of Shake of Rope (mm) after shaking at $D_T$ n: Machine

Lt: Cage Position

R: Target Rope (Ropes A, B, C, D)

$\Delta D_R$: Increase/Decrease Amount of Shake of Rope

Figure 3:
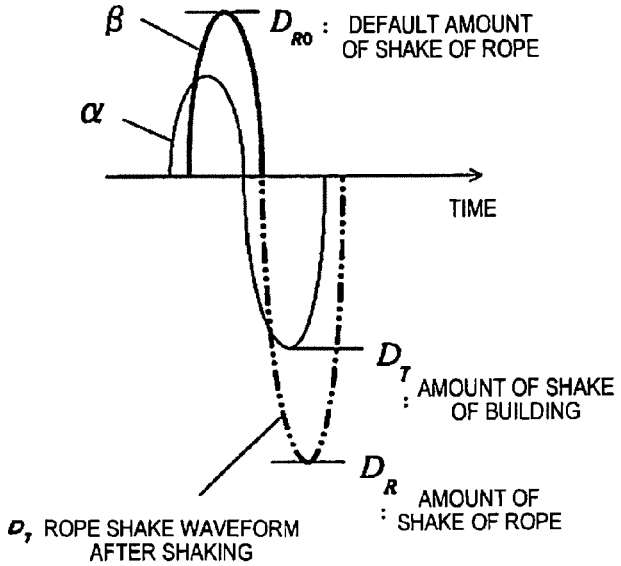
FIG. 3 is a waveform diagram illustrating a relationship between a shake of a building and contact of a long object according to the embodiment of the present invention.

FIG. 3 illustrates a relationship between a building shake waveform α and a rope shake waveform β. In FIG. 3, in a state of the default amount of shake of rope (the current amount of shake of rope) $D_{R0}$, the amount of shake of a rope $D_R$ after a shake of a building shake $D_T$ is applied next is represented by above equation (1).

Meanwhile, a sign and a value of $\Delta D_R$ change according to the machine n/the cage position Lt/the target rope R/the default amount of shake of a rope $D_{R0}$/the building shake $D_T$. Growths of shakes of a rope under all assumable conditions are calculated by the above simulator, and are converted into tables and functions as illustrated in FIG. 2. Further, by extracting $\Delta D_R$ from the table upon cross-reference to current information, the amount of shake of a rope is estimated in real time.

Figure 4:
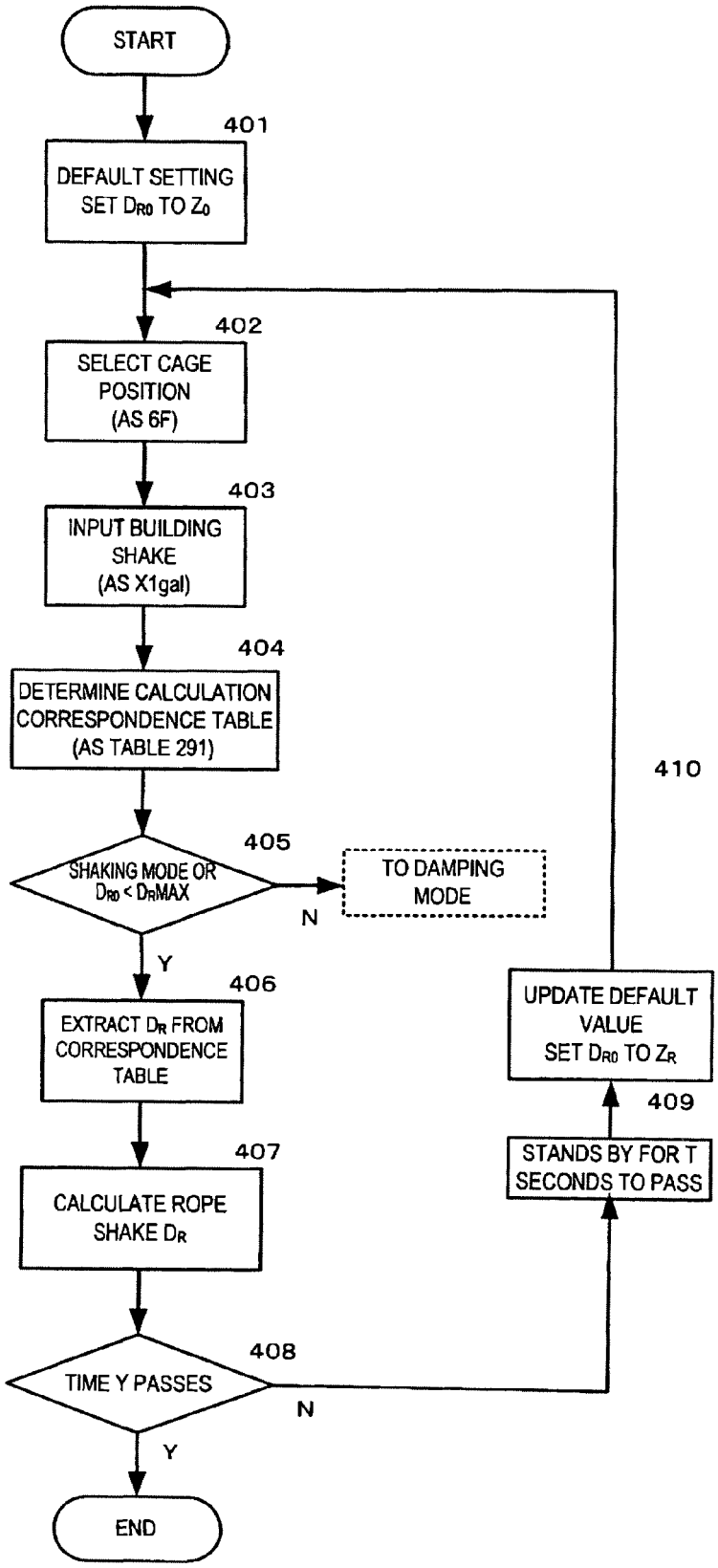
FIG. 4 is a flowchart for explaining a simulation operation according to the embodiment of the present invention.

Next, an example of specific process of calculating the amount of shake of rope using the data tables 29 will be described in association with operation steps in a flowchart illustrated in FIG. 4.

Calculation Process 0: Default Setting

Before a calculation routine is started, each current rope shake default value $D_{R0}$ is set to an arbitrary value $Z_0$ [mm] (step 401).

Calculation Process 1: Select Cage Position

A cage position closest in the table 29 is selected from current cage position information (step 402). For example, the cage position of the machine 1 is 6 F.

Calculation Process 2: Input Shake of Building

A current building shake peak value (X1gal) is inputted from an output of the current building shake sensor 30 (step 403).

Calculation Process 3: Calculate Corresponding Table

A table corresponding to each rope is calculated according to the conditions of the calculation processes 1 and 2 (step 404).

The building shake is X1gal, and the table 291 in FIG. 2 is calculated for the rope A of the above machine 1.

Calculation Process 4: Determine whether Each Rope is Shaking Mode

A value $Z_0$ of a current default amount of shake of a rope $D_{R0}$ set in advance, and a rope shake maximum value $D_R$MAX at a corresponding cage position are compared and determined (step 405).

A maximum value among values $a_{61}$~$a_{6Y}$ of the amounts of shake of a rope $D_R$ at 6 F of the cage position in the table 291 in FIG. 2 is $D_R$MAX and a value $Z_0$ of $D_{R0}$ are compared, and, when $D_{R0}$<$D_R$MAX holds as a result, a shaking mode is determined. The rope A of the machine 1 is in the shaking mode. In addition, when determination in this step 405 is No, the rope transitions to a damping mode. Computation in the damping mode is not directly relevant to the present invention, and therefore will not be described.

Calculation Process 5: Calculate Increase/Decrease Amount of Shake of Rope $\Delta D_R$ in Shaking Mode The increase amount of shake of a rope $\Delta D_R$ after T seconds upon the default amount of shake of a rope $D_{R0}$ of each rope is extracted from a table (step 406).

From the values $a_{61}$~$a_{6Y}$ of the amount of shake of a rope $D_R$ at 6 F of the cage position in the table 291, a value closest to the value $Z_0$ of the default amount of shake of the rope $D_{R0}$ is selected for the rope A of the machine 1. Meanwhile, a value $a_{62}$ is a value closest to the value $Z_0$. Further, a value $a_{d1}$ of a difference between this value $a_{62}$ and the value $a_{63}$ after T seconds is extracted from the table 291 as the increase amount of shake of a rope $\Delta D_R$ after T seconds.

Calculation Process 6: Calculate Amount of Shake of Rope $D_R$ of Each Rope

From the value $Z_0$ of the default amount of shake of a rope $D_{R0}$ set in advance and the value $a_{d1}$ of the increase amount of shake of a rope $\Delta D_R$ extracted from the table 291, the amount of shake of a rope $D_R$ after T seconds is calculated according to above equation (1) for the rope A of the machine 1 (step 407). That is, a value obtained by adding the value $a_{d1}$ of the increase amount of shake of a rope $\Delta D_R$ to the value $Z_0$ of the default amount of shake of a rope $D_{R0}$ is calculated as the amount of shake of a rope $D_R$ ($Z_1$) after T seconds from the present.

The above calculation processes 1 to 6 are repeated every T second until a time Y passes (steps 408 and 409), and the amount of shake of a rope $D_R$ at each point of time is calculated. The calculated amount of shake of a rope $D_R$ is compared with a threshold set in advance and whether or not a control operation needs to be performed is determined.

When the calculation processes 1 to 6 are repeated every T second, a value of the amount of shake of a rope $D_R$ ($Z_1$ in the above example) calculated upon previous computation is used as a value of the current default amount of shake of the rope $D_{R0}$ (step 410). Further, when the position of the passenger cage is different from a previous position after T seconds pass, computation is performed using information of another cage position on the table 291 (step 402). Furthermore, when the amount of shake of the building changes after T seconds pass, a table corresponding to the current amount of shake is used (steps 403 and 404). When, for example, the amount of shake of the building changes to X3gal, computation is performed using data of the table (293) corresponding to the amount of shake.

Thus, the simulating unit 23 changes every second a physical model of simulation using data of the data table 29, so that it is possible to accurately calculate in real time the amount of shake of a long object from the current amount of shake of a building and passenger cage position information without stopping an operation of the elevator.

Further, a control operation of the elevator is performed based on the amount of shake of the long object calculated in real time, so that it is possible to effectively prevent a catch due to a shake of the long object. Furthermore, although, when a building is shaken, an elevator is first stopped at all times according to the conventional technique, the amount of shake of a long object can be estimated in a state where the operation of the elevator is continued, so that it is possible to dramatically reduce a stop frequency of the elevator and improve operation service according to the present embodiment.

In addition, a rope shake data table per load capacity of the passenger cage 14 may be prepared in advance as a configuration of the data table 29, and the amount of shake of a rope may be calculated additionally using a cage load capacity of a real machine. By so doing, precision to estimate the amount of shake of a rope further improves.

According to the embodiment, a simulation model is changed every second according to, for example, a passenger cage position upon an operation of an elevator, and the amount of shake of a long object caused by a shake of a building is estimated, so that it is possible to accurately learn the current amount of shake of a long object caused by the shake of the building. Consequently, it is possible to reduce a stop frequency of the elevator and improve operation service of the elevator compared to a conventional technique.

While certain embodiments have been described, those embodiments have been presented by way of ex ample only, and are not intended to limit the scope of the inventions. Indeed, the novel embodiments described herein may be embodied in a variety of other forms; furthermore, various omissions, substitutions and changes in the form of the embodiments describe mad herein may be made without departing from the spirit of the invention. The accompanying clams and their equivalents are intended to cover such forms or modifications as would fall within the scope and spirit of the invention.

What is claimed is:

1. An elevator operation control method of: estimating an amount of shake of a long object which moves accompanying lifting and lowering of a passenger cage by way of simulation based on an amount of shake of a building in which an elevator is installed and current position information of the passenger cage of the elevator; and controlling and operating the elevator according to the estimated amount of shake of the long object, the elevator operation control method comprising:

changing every second a physical model of the simulation according to the position of the running passenger cage, and simulating in real time the amount of shake of the long object from the current amount of shake of the building and position information of the running passenger cage; and when the amount of shake of the long object calculated by the simulation exceeds a threshold determined in advance, performing a control operation matching this threshold.

2. The elevator operation control method according to claim 1, wherein: according to the simulation, the amount of shake of the long object in case that the passenger cage which is at a current position upon the current amount of shake of the building arrives at a destination floor is predicted using position information of the destination floor; and when the amount of shake of the long object of the destination floor is expected to exceed the threshold, the destination floor is changed.

3. The elevator operation control method according to claim 1, wherein: a time-series change of the amount of shake of the long object corresponding to the amount of shake of the building at all positions of the passenger cage corresponding to a plurality of height positions of the building set in advance is calculated in advance, and a result is converted into a table; and a physical model of the simulation estimates in real time the amount of shake of the long object using corresponding information which is converted into the table from the current amount of shake of the building and the position of the passenger cage.

4. An elevator operation control device comprising: a simulating unit which estimates an amount of shake of a long object which moves accompanying lifting and lowering of a passenger cage based on an amount of shake of a building in which an elevator is installed and current position information of the passenger cage of the elevator; and a control unit which controls and operates the elevator according to the amount of shake of the long object estimated by the simulating unit, wherein:

the simulating unit changes every second a physical model of the simulation according to the position of the running passenger cage, and simulates in real time the amount of shake of the long object from the current amount of shake of the building and position information of the running passenger cage; and the control unit which, when the amount of shake of the long object calculated by the simulation exceeds a threshold determined in advance, performs a control operation matching this threshold.

5. The elevator operation control device according to claim 4, wherein: the simulating unit comprises a function of predicting the amount of shake of the long object in case that the passenger cage which is at a current position upon the current amount of shake of the building arrives at a destination floor, using position information of the destination floor; and the control unit comprises a function of, when the amount of shake of the long object upon arrival at the destination floor is expected to exceed the threshold, changing the destination floor.

6. The elevator operation control device according to claim 4, wherein: the simulating unit calculates in advance a time-series change of the amount of shake of the long object corresponding to the amount of shake of the building at all positions of the passenger cage corresponding to a plurality of height positions of the building set in advance, and converts the result into a table; and a physical model of the simulation estimates in real time the amount of shake of the long object using corresponding information which is converted into the table from the current amount of shake of the building and the position of the passenger cage.

* * * * *